United States Patent [19]

Polizzotti et al.

[11] 4,424,083

[45] Jan. 3, 1984

[54] CARBURIZATION RESISTANCE OF AUSTENITIC STAINLESS STEEL TUBES

[75] Inventors: Richard S. Polizzotti, Milford; Richard C. Krutenat, New Providence, both of N.J.

[73] Assignee: Exxon Research and Engineering Co., Florham Park, N.J.

[21] Appl. No.: 453,451

[22] Filed: Dec. 27, 1982

Related U.S. Application Data

[63] Continuation-in-part of Ser. No. 208,986, Nov. 21, 1980, Pat. No. 4,379,745.

[51] Int. Cl.[3] ..... C22F 1/11

[52] U.S. Cl. ..... 148/12 E

[58] Field of Search ..... 148/12 E, 6.35; 208/47, 208/132

[56] References Cited

U.S. PATENT DOCUMENTS

| | | | |
|---|---|---|---|
| 3,704,333 | 11/1972 | Spengler | 260/683 |
| 3,844,846 | 10/1974 | Friske | 148/12 E |
| 3,919,073 | 11/1975 | Bagmoli | 208/48 R |
| 4,086,104 | 4/1978 | Kinoshitg | 148/12 E |

OTHER PUBLICATIONS

The Gaseous Carburization of Austenitic Steels, Werkstoffe und Korrosion, vol. 30, 785–794 (1979).

First Petten Colloguium on Advanced High Temperature Materials: Technology & Industrial Aspects, Jan. 20–30, 1976, H. Krockel.

Carburization of Centrifugally Cast Pipe in the Petrochemical Industry and Explanation of this Behavior Through Laboratory Experiments with Chrome--Nickel Steels and Materials in the 800°–1500° C. Range, W. Steinkusch, Werkstoffe und Korrosion 28 (1):1–6 1977.

A Newly Developed Extruded Tube for Reformer and Cracking Tubes, by S. Ohta, from Chemical Economy and Engineering Review, vol. 3, No. 10 (No. 42), Oct. 1971.

*Primary Examiner*—Sam Silverberg

*Attorney, Agent, or Firm*—Henry E. Naylor

[57] ABSTRACT

Protection of cast austenitic stainless steel tubes is provided against initiation of carburization by (a) cold-working the inner surfaces of said tubes to deform the surface to such a degree that upon the subsequent heat treatment of step (b) below, dissolution of the $M_{23}C_6$ carbides in the deformed region is accompanied by recrystallization resulting in a refined micrograin structure in the deformed regions to a substantially uniform minimum depth of about 20 microns; and (b) heating the cold-worked inner surfaces of said tubes, for an effective amount of time, at a temperature between its recrystallization temperature and its melting temperature, in an atmosphere of which the oxygen partial pressure is at least oxidizing with respect to chromium.

18 Claims, 5 Drawing Figures

75 μm

75 μm

75 μm

UNPEENED PEENED

CARBURIZATION RESISTANCE OF AUSTENITIC STAINLESS STEEL TUBES

This is a continuation-in-part application of U.S. Ser. No. 208,986 filed Nov. 21, 1980 now U.S. Pat. No. 4,379,745.

BACKGROUND OF THE INVENTION

The present invention relates to an improved method for protecting cast austenitic stainless steel tubes against carburization when such tubes are employed in high temperatures carburizing environments, such as in the stream cracking of hydrocarbons.

A variety of heat-resistant alloy steels have been developed for use in pyrolysis furnaces for the thermal decomposition of organic compounds, such as the steam cracking of hydrocarbons. Generally, the pyrolysis furnace contains a series of heat-resistant alloy steel tubes in which the reaction occurs. It will be noted that the term "tube" as used herein also includes fittings, pipes and other parts used to contain carburizing materials.

While it is well-known that alloy steels containing various amounts of nickel and chromium are useful in constructing heat-resistant pyrolysis tubes having relatively long performance lives, premature tube failure continues to be the limiting problem. A major cause of such failure is carburization of the tubes brought about by the extremely high temperatures and carburizing atmospheres encountered. Carburization of such tubes, which is the diffusion of carbon into the alloy steel causing the formation of additional carbides, brings about the embrittling thereof. Once the steel has become embrittled, it is susceptible to creep rupture failure, and/or brittle fracture due to thermal stress. Carburization often occurs at localized spots in the tubes, and of course when this has proceeded to the point of failure or potential failure, even at only one spot, the tubing must be replaced.

Although progress has been made in improving the carburization resistance of such tubes by conventionally machining the inner surfaces of the tubes prior to use, it has been found that such machining only improves the carburization resistance to a very limited degree.

SUMMARY OF THE INVENTION

In accordance with the pesent invention there is provided a method for improving the carburization resistance of cast austenitic stainless steel tubes, which method also produces such carburization resistance uniformly over the entire inner surface of the tubes. The method comprises: (a) cold-working the inner surfaces of said tubes to deform the surface to such a degree that upon the subsequent heat treatment of step (b) below, dissolution of the $M_{23}C_6$ carbides in the deformed region is accompanied by recrystallization resulting in a refined micrograin structure in the deformed regions to a substantially uniform minumum depth of about 20 microns; and (b) heating the coldworked inner surfaces of said tubes, for an effective amount of time, at a temperature between its recrystallization temperature and its melting temperature, in an atmosphere of which the oxygen partial pressure is at least oxidizing with respect to chromium; wherein the cast austenitic stainless steel comprises about 17 to 40 wt.% chromium, about 15 to 50 wt.% nickel, and about 0.6 to 4 wt.% silicon, based on the total weight of the alloy.

In one preferred embodiment of the present invention, the cold-working is performed by shot-peening.

In another preferred embodiment of the present invention, the inner surfaces of the tubes, prior to application of this invention, are substantially that of the bulk composition and the surface roughness is less than about 300 r.m.s.

In yet another preferred embodiment of the present invention, the cast austenitic stainless steel tubes are those containing about: 17 to 40 wt.% chromium; 15 to 50 wt.% nickel; 0.06 to 0.6 wt.% carbon; up to about 2 wt.% manganese; 1 to 2.5 wt. % silicon; up to about 2 wt.% niobium, up to about 2 wt.% molybdenum, up to about 3 wt.% tungsten, up to about 17 wt.% cobalt and the balance being iron, wherein all weight percents are based on the total weight of the alloy.

DETAILED DESCRIPTION OF THE INVENTION

Figure 1:
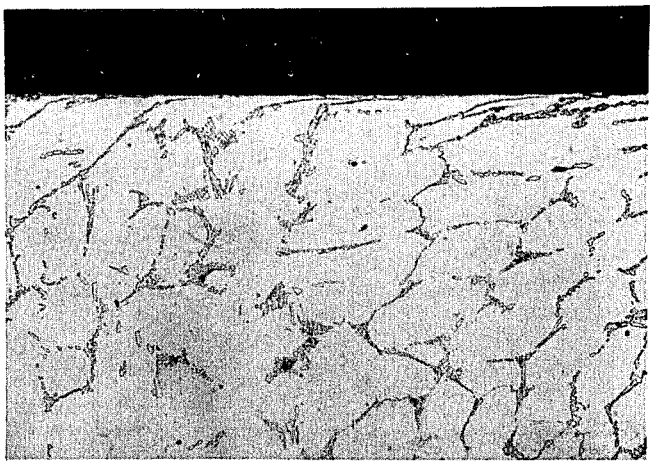
FIG. 1 shows the microstructure (200 magnifications) of the inner surface of a cast austenitic stainless steel tube of the type employed in Examples 1 and 2 and comparative Example A, before treatment, and surface machined at the foundry to about 60 r.m.s.

Austenitic stainless steel tubes suitable for the practice of the present invention are those tubes which are fabricated by casting methods and are those containing about; 17 to 40 wt.% chromium, 15 to 50 wt.% nickel, and 0.6 to 4 wt.% silicon.

Preferably, the austenitic stainless steel is one containing about; 17 to 40 wt.% chromium, 15 to 50 wt.% nickel, 0.06 to 0.6 wt.% carbon, 1 to 2.5 wt.% silicon, up to about 2 wt.% manganese, up to about 3 wt.% tungsten, up to about 2 wt.% molybdenum, up to about 2 wt.% niobium, and the balance being iron.

More preferred are those HK and HP type austenitic stainless steels. For example, the HK type steels are generally those containing about; 20 to 30 wt.% chromium, 16 to 24 wt.% nickel, 0.2 to 0.5 wt.% carbon, 0.6 to 2 wt.% silicon and up to about 2 wt.% manganese, and the balance being iron. The HP type alloy steels are generally those containing about; 20 to 30 wt.% chromium, 30 to 40 wt.% nickel, 0.06 to 0.8 wt.% carbon, 0.6 to 2 wt.% silicon, 0.5 to 2 wt.% manganese, up to about 2 wt.% molybdenum, up to about 3 wt.% tungsten, and the balance being iron. It is to be understood that all weight percents herein are based on the total weight of the alloy.

In referring to the iron content of the alloys as constituting the "balance", it is to be understood that impurities as well as other elements and substances may be present. Such other elements and substances may each be present at levels up to about 5 wt.%. Non-limiting examples of such elements and substances include nitrogen, copper, aluminum, hafnium, titanium, rare earth elements, etc. Minor amounts or impurities typically found in such alloys may also be present, as well as tramp elements such as lead, tin, zinc, selenium, etc.

For purposes of the present invention, it is preferred to cold-work the tube surfaces by methods which exert substantially compressive forces, preferably primarily compressive forces, on the worked surface. One such preferred method is peening, more preferably shot-peening. Other cold-work methods may also be employed as long as they are capable of deforming the inner surface of the tube in such a way and to such a severity that upon subsequent heat treatment recrystallization of the surface will occur to a substantially uniform minimum depth of at least about 20 microns, preferably at least about 40 microns, more preferably at least about 70 microns, and most preferably at least about 100 microns. This recrystallized zone can be characterized as: (1) having a refined micrograin structure smaller than the original micrograin structure, that is, the micrograin structure before cold-working according to the present invention (preferably the resulting refined micrograin structure is from about 1/5 to about 1/10 the size of the original micrograin structure); (2) being to a uniform minimum depth of at least about 20 microns; and (3) preferably being substantially free of microporosity.

Cold-working methods such as conventional machining, which exert primarily shearing forces, as opposed to compressive forces, to the inner tube surface, are not suitable for use herein. Such methods do not create the necessary uniform minimum depth of recrystallization and are capable of eliminating microporosity only at the vey near surface of the tube. Non-limiting examples of cold-working methods preferred herein include shot-peening, swagging, pilgering, grit blasting, and machining in a manner which will deform the tube surface sufficiently to obtian a recrystallized zone as previously characterized.

It is also preferred that the inner surface of the tube, after treatment according to the present invention, be substantially smooth. By substantially smooth we mean a surface roughness less than about 200 r.m.s., preferably less than about 100 r.m.s., more preferably less than about 50 r.m.s.

Shot-peening is conventionally used for cold-working metallic surfaces, primarily to increase the fatigue life and to prevent stress corrosion cracking of metal parts. It is also conventionally used to form parts, to correct their shape, and to work-harden surfaces. In shot-peening, the surface to be peened is bombarded to a given intensity (measured in Almen units) with round steel or nonmetallic shot of a particular size. The shot is blasted under controlled conditions, including velocity and time, from either a hand-held nozzel or a special machine. Every piece of shot effectively acts as a tiny peening hammer.

For purposes of the present invention, ferritic steel shot having a diameter of about 0.015 to 0.250 inches can be used for initial bombardment in one or more passes of the inner tube surface to achieve the desired degree of surface deformation. The surface can then be peen-honed by a subsequent bombardment with shot, which is sufficiently smaller or sufficiently larger to reduce surface roughness caused by initial bombardment. Preferred is a surface smoothness of less than about 200 r.m.s. and most preferred is a surface smoothness of less than about 50 r.m.s.

When a surface is completely peened (100 percent coverage) at conventional intensities by a multitude of impacts, which is determined by visual inspection, the resultant stressed surface is in a state of uniform compressive deformation. Generally, surface coverage from about 100 to 200 percent will suffice to provide the desired uniform compressive deformation in the material being shot-peened.

Shot-peening of tubes treated in accordance with the present invention can be performed with the type apparatus apparatus disclosed in U.S. Pat. No. 3,648,498 and incorporated herein by reference. That patent also refers to several other shot-peening processes as well as to the conventional method of expressing and measuring the peening severity in terms of Almen intensity, in accordance with SAE Test J 442, which method was employed in the examples herein. In that test, a thin flat piece of steel is clamped or otherwise secured to a solid block and exposed to a blast of shot, which tends to compress the surface so that the strip will be curved when removed from the block. The extent of curvature is proportional to the peening intensity, which is a function of the weight, size, hardness and velocity of the peening particles, exposure time, type of substrate, angle of impingement, and various other factors.

The use of Almen intensity for the purposes of the present invention provides control reproducibility of the peening shot-stream and does not necessarily provide sufficient indication as to the effectiveness of the peening on the surface to be protected. This effectiveness must be determined basically by metallographic examination of the treated specimen to determine the degree of surface deformation desired. For example, a cast equiaxed tubular austenitic stainless steel material having an average micrograin size, as cast, of about 100 to 250 microns will preferably have a peened surface, after treatment according to the invention, characterized by an average micrograin size of about 10 to 15 microns to depths preferably greater than about 100 microns. Of course, the precise intensity at which the tube surfaces are to be shot-peened would have to be determined for each type tube material, shot; etc., in order to give a desired surface deformation. Such deformation can be determined by those having ordinary skill in the art by routine experimentation; and, therefore, will not be discussed in further detail.

In cold-working the tube surfaces in accordance with the present invention, care must be taken not to cold-work the surface to such a severity that would adversely affect the bulk mechanical properties of the tube.

After the inner surface of the tube has been deformed to the desired degree by cold-working, it is heated to a temperature between its recrystallization temperature and its melting temperature in a sufficiently oxidizing atmosphere for at least an effective amount of time. By sufficiently oxidizing atmosphere, we mean an atmosphere at the given temperature which will oxidize chromium and all other elements whose oxide have a standard heat of formation greater than that of chromium at such given temperature. For example, at 1000° C., elements such as chromium, manganese, silicon, and aluminum will be oxidized in accordance with the instant invention wherease elements such as iron, cobalt, nickel and copper will not.

By, at least an effective amount of time, we mean at least the amount of time needed to allow dissolution of the $M_{23}C_6$ carbides in the deformed region accompanied by the development of a refined micrograin structure to a uniform minimum depth of 20 microns, preferably 40 microns, more preferably 70 microns, and most preferably 100 microns. That is, the recrystallization of the deformed surface region, in the oxidizing environment herein described, must be carried out in such a way that the resulting refinement of the surface micrograin structure remains stable as the $M_{23}C_6$ carbides in the deformed surface region dissolve. These $M_{23}C_6$ carbides are predominantly chromium carbides. For example, temperatures from about 640° C. to about 800° C. in steam, are employed at times of at least about 200 hours, preferably at least about 500 hours. If the oxygen partial pressure is lower than that of steam, longer periods of time would be required.

Non-limiting examples of atmospheres which may be employed during recrystallization and oxide formation include steam, a mixture of hydrogen and steam, and a mixture of steam and a hydrocarbon feed such as those feeds employed in a steam cracking operation.

To generally illustrate the invention, the inner surface of an HP cast austenitic stainless steel tube can be cold-worked, preferably by shot-peening in several initial passes with 0.055" diameter ferritic steel shot to an Almen intensity of 8C. A subsequent peen-honing operation with 0.015" ferritic steel shot can be employed to reduce the surface roughness which may have been introduced during the initial shot-peening operation. The peened surface can then be heated to a temperature between about 480° and 1150° C. preferably about 640°-800° C. in a sufficiently oxidizing atmosphere, preferably in steam alone, more preferably in a hydrogen/steam mixture, such that the oxygen partial pressure is oxidizing with respect to chromium. During this oxidizing heat treatment, oxidation of the surface is accompanied by recrystallization and development of the refined micrograin structure of the deformed surface region. The deformation, which for the most part is pinned by the carbides present in the alloy, recrystallizes as the $M_{23}C_6$ type carbides dissolve. This results in an average surface micrograin size of about 10–15 microns to a minimum depth of at least 20 microns while the bulk micrograin size of the material remains essentially unchanged, that is, average bulk micrograin sizes generally from about 100–250 microns.

The austenitic stainless steel tubes, as treated in accordance with the present invention, are particularly suited for use in the steam cracking of hydrocarbons. Steam cracking is a process well-known in the art for forming products such as $C_2$ to $C_4$ olefins and diolefins from feeds such as gas oil, naptha and ethane. Generally, the temperature employed in steam cracking ranges from about 650° C. to about 1000° C. at about 20 to 90 mol % steam. The feedsteam mixture is passed through a conventional steam cracking furnace which contains pyrolysis tubes or coils treated in accordance with the present invention.

The following examples serve to more fully describe the manner of making and using the abovedescribed invention, as well as to set forth the best modes contemplated for carrying out various aspects of the invention. It is understood that these examples in no way serve to limit the true scope of this invention, but rather are presented for illustrative purposes.

EXAMPLE 1

A case austenitic stainless steel tube having an inner diameter of 9.5 cm and comprising about 24.93 wt.% Cr, 36.38 wt.% Ni, 1.53 wt.% Mn, 1.63 wt.% Si, 1.10 wt.% Mo, 0.42 wt.% C, 0.015 wt.% P, 0.007 Wt.% S, 0.01 wt.% Nb, 4.2 ppm W, and the balance being substantially iron, was machined to a surface roughness of about 60 r.m.s. The tube was then shot-peened using commericial shot-peening equipment. The inner surface of the tube was bombarded with 0.055 inch diameter ferritic steel shot having a hardness of 45-55C Rockwell in 6 passes (about 600% total surface coverage) to an Almen intensity of 9C. A subsequent peen-honing operation using the same apparatus was performed with 0.033 inch diameter ferritic steel shot in one pass (about 100% surface coverage) in order to reduce surface roughness caused by the initial shot-peening operation. This subsequent shot-peening was performed at an Almen intensity of 10A. The surface roughness after the entire shot-peening operation, and the heat treatment discussed below was about 150 to 200 r.m.s. The surface structure was deformed to an average depth of about 300 to 350 microns.

Figure 2A:
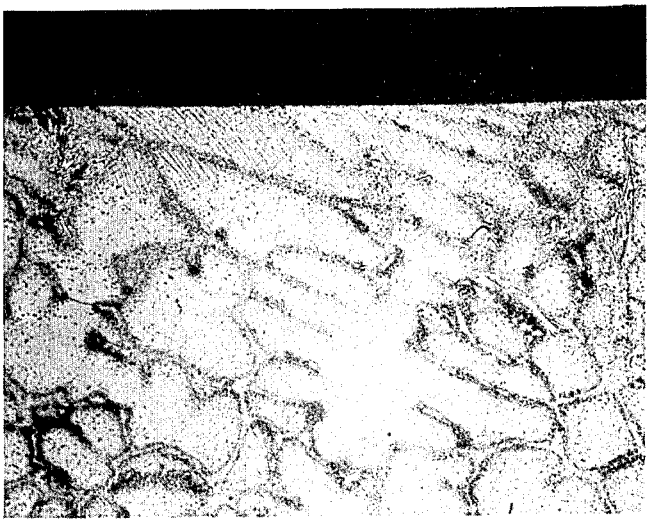
FIGS. 2A and 2B show the microstructures (200 magnifications) of the inner surface of the tubes employed in Comparative Example A and Example 1, respectively. They depict the micrograin structure of the inner surface of each tube after heat treatment, but before being employed in the high temperature carburizing environment.
Figure 2B:
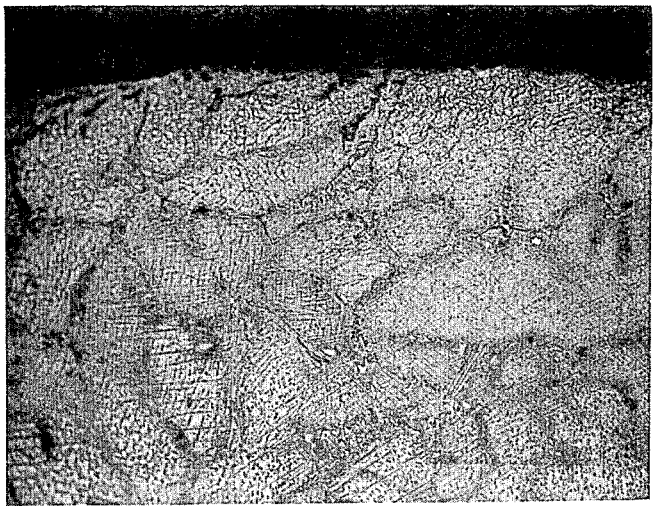

The shot-peened tube was heat treated at a temperature of about 840° C. for 24 hours in a hydrogen/steam environment having a dew point of 60° C., which is equivalent to an oxygen partial pressure of $6\times10^{-20}$ atmospheres. The microstructure of the treated inner surface was analyzed and is represented by FIG. 2B. The microstructure was found to contain a fine equiaxed uniform micrograin structure to a depth of about 75 to 100 microns. The refined surface structure was also found to be substantially non-porous and the surface was found to have a roughness of about 150–200 r.m.s.

The peened and heat-treated tube was installed in a commercial steam cracking furnace so that it was welded to similar type tubes which had only undergone machining to about 60 r.m.s. before installation in the furnace. The furnace was brought up to a temperature of about 780° to 850° C. and maintained at that temperature for several hours with only steam passing through the tubes.

Figure 3A:
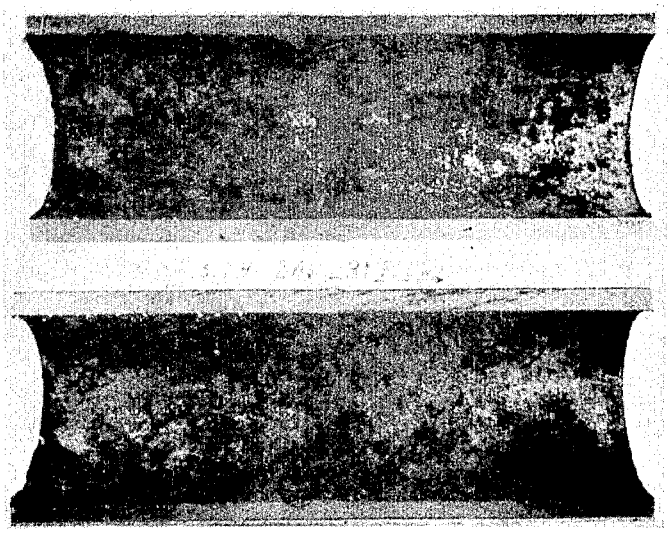
FIGS. 3A and 3B are photographs of the surface oxides on the inner surfaces of the tubes employed in Comparative Example A and Example 1, respectively, after use in the high temperature carburizing environment.
Figure 3B:
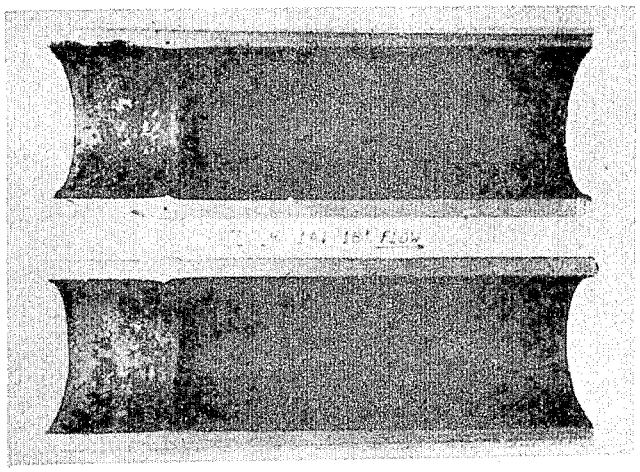

Naphtha feed of $C_5$-85° C. boiling range was then continually introduced for a period of approximately three months, and cracked at varying steam to naphtha ratios of about 0.6 to 0.3 lbs. of steam per lb. of naphtha. The tube was removed from service and the inner surface of the tube was analyzed. FIG. 3B is a photograph of a section of the tube, treated in this example, welded to a section of untreated tube, and cut lengthwise into halves. As is evidenced by this photograph, the treated tube section, which is to the right of weld joint, shows no evidence that carburization had been initiated. The untreated tube section to the left of the weld joint in FIG. 3B, which was merely conventionally machined to a surface roughness of about 60 r.m.s., evidences substantial spalling of the surface oxide layers.

COMPARATIVE EXAMPLE A

A cast austenitic stainless steel tube of identical composition and dimension of that employed in Example 1 above was also conventionally machined to a surface roughness of about 60 r.m.s. The tube did not undergo shot-peening. The microstructure of the inner surface of the tube was analyzed: a representative portion of which is shown in FIG. 2A. As can be seen by comparison with FIG. 2B, without shot-peening, the surface structure did not recrystallize after heat treatment at 840° C. for 24 hours to form a zone of fine equiaxed grains.

the untreated tube was then operated in the same commercial naphtha steam cracking furnace, under the same conditions, and for the same length of time as the tube employed in Example 1 above. The tube was removed from steam cracking service and its inner surface analyzed with respect to microstructure, oxide structure and carburization. FIG. 3A is a photograph of a section of the tube cut lengthwise into halves. As is evidenced in the photograph, the surface oxide has experienced severe spalling and the dark circled areas are areas where substantially carburization was found to have occurred. Comparison of this tube with the tube shown in FIG. 3B dramatically illustrates the criticality of protecting the inner tube surface in accordance with the present invention.

A comparison of the surface microstructures shown in FIGS. 1, 2A and 2B shows the following:

FIG. 1 is a photomicrograph of the surface microstructure of the inner surface of an as-received tube of identical composition as those employed in Example 1 and Comparative Example A herein, and machined to a surface roughness of about 60 r.m.s. In the photomicrograph, the light grey network are $M_{23}C_6$ interdentritic carbides which define the 100–250 micron micrograins of the bulk alloy. The region nearest the surface shows the carbides smeared to the right and defines the zone of deformation caused by the machining process. This illustrates that little or no deformation of the surface structure results from conventional machining processes. What little deformation there is is confined very close to the surface.

FIG. 2A is a photomicrograph of the surface microstructure of the inner surface of an as-received tube and treated in accordance with Comparative Example A herein. The photomicrgraph shows that if the conventionally machined tube is not cold-worked according to the invention, but nevertheless undergoes subsequent heating to above its recrystallization temperature in an oxidizing atmosphere, the desired refined micrograin structure is not obtained. In FIG. 2A, the light grey network again represents the $M_{23}C_6$ interdentritic carbides. The diagonal lines at approximately 45° angles to the surface represents deformation resulting from the conventional machining operation. This photomicrograph also evidences that the deformation caused by conventional machining is non-uniformly distributed along the surface and that recrystallization of the surface region has only occurred in a few isolated places.

FIG. 2B is a photomicrograph of the microstructure of the inner surface of the tube treated in accordance with Example 1 herein. The inner surface of this tube was conventionally machined to a roughness of about 60 r.m.s., shot-peened, and heat treated in an oxidizing atmosphere. This photomicrograin shows remnants of the light grey network representing the interdentritic carbides. It will be noted that this carbide network, defining the original micrograin structure, appears below a continuous recrystallized zone to a uniform minimum depth comprised of a greatly refined micrograin structure. This microphotograph illustrates the importance of cold-working the tube surface, in accordance with the present invention, prior to heat treatment above its recrystallization temperature and in a sufficiently oxidizing atmosphere.

EXAMPLE 2

A cast austenitic stainless steel tube of identical composition and dimension as that used in the above example was also conventionally machined to a surface roughness of about 60 r.m.s. and shot-peened as described in Example 1 above. The microstructure of the shot-peened surface was analyzed and was found to be substantially the same as the shot-peened tube of Example 1, above, that is, after peening, but before service. This shot-peened tube did not undergo a separate oxidizing heat-treatment before being employed in a naphtha steam cracking furnace under the same conditions and for approximately the same length of time as the tubes of the above examples. After service, the tube was removed and the inner surface was analyzed and was found to be substantially the same as that of Example 1 above, after service.

This example illustrates that a tube which is shot-peened according to the present invention can provide adequate protection against carburization if placed directly in a naphtha steam cracking furnace which undergoes a start-up period with steam alone at temperatures above the recrystallization temperature of the tube and for a period of time long enough to cause dissolution of the $M_{23}C_6$ carbides in the deformed zone while maintaining a refined micrograin structure to a uniform minimum depth of at least about 20 microns.

COMPARATIVE EXAMPLE B

A cast austenitic stainless steel tube having the identical composition and dimension as those of the previous examples, was prepared and employed according to the procedures set forth in Example 2 above, except that the tube was not shot-peened. The tube was operated side-by-side with the tube of Example 2 in the naphtha steam cracking furnace. After removing the tube from service and analyzing the inner surface, it was found that substantial oxide spalling had occurred and that localized spots of carburization had begun as shown by the dark circled areas in FIG. 3A. This example, again, illustrates that it is critical to cold-work the inner surface of the tube to such a degree as to provide a uniform minimum zone of fine recrystallized micrograins and dissolution of the $M_{23}C_6$ carbides in the deformed surface region.

What is claimed is:

1. A method for enhancing the protection of a cast austenitic stainless steel tube against carburization, the method which comprises:

(a) shot-peening the inner surface of said tube to deform the surface of said tube to such a degree that upon the subsequent heat treatment of step (b) below, dissolution of the $M_{23}C_6$ carbides in the deformed region is accompanied by recrystallization resulting in a refined micrograin structure, in the deformed surface region, to a uniform minimum depth of at least about 20 microns, and (b) heating the shot-peened inner surface of the tube, for an effective amount of time, at a temperature between its recrystallization temperature and its melting temperature, in an atmosphere which is at least oxidizing with respect to chromium, wherein the cast austenitic stainless steel tube comprises about; 17 to 40 wt.% chromium, 15 to 50 wt.% nickel, and 0.6 to 4 wt.% silicon, based on the total weight of the alloy.

2. The method of claim 1 wherein the refined recrystallized micrograin structure is to a uniform minimum depth of at least about 70 microns.

3. The method of claim 2 wherein the refined recrystallized micrograin structure is to a uniform minimum depth of at least about 100 microns.

4. The method of claims 1, 2 or 3 wherein the oxidizing atmosphere is selected from the group consisting of steam and a mixture of steam and hydrogen.

5. The method of claim 4 wherein the shot-peened surface is heated, in the oxidizing atmosphere, to a temperature of about 420° C. to about 800° C. for about 200 to about 500 hours.

6. The method of claim 4 wherein the austenitic stainless steel is comprised of about: 20 to 30 wt.% chromium, 16 to 24 wt.% nickel, 0.2 to 0.5 wt.% carbon, 0.6 to 2 wt.% silicon, up to 2 wt.% manganese, and the balance being iron, based on the total weight of the alloy.

7. The method of claim 4 wherein the austenitic stainless steel is comprised of about: 20 to 30 wt.% chromium, 30 to 40 wt.% nickel, 0.6 to 0.8 wt.% carbon, 0.6 to 2 wt.% silicon, 0.5 to 2 wt.% manganese, up to about 2 wt.% molybdenum, up to about 3 wt.% tungsten, and the balance being iron, based on the total weight of the alloy.

8. The method of claim 4 wherein the inner sufrace of the tube, before shot-peening is substantially that of the bulk composition and the surface roughness is less than about 300 r.m.s.

9. The method of claim 8 wherein the recrystallized micrograin structure is substantially free of microporosity.

10. A method for enhancing the protection of a cast austenitic stainless steel tube against carburization, the method which comprises:

(a) cold-working the inner surface of said tube to deform the surface to such a degree that upon the subsequent heat treatment of step (b) below, dissolution of the $M_{23}C_6$ carbides in the deformed region is accompanied by recrystallization resulting in a refined micrograin structure, in the deformed region, to a uniform minimum depth of at least about 20 microns, and (b) heating the cold-worked inner surface of the tube, for an effective amount of time, at a temperature between its recrystallization temperature and its melting temperature in an atmosphere which at least oxidizing with respect to chromium;

wherein the cast austenitic stainless steel tube comprises about: 17 to 40 wt.% chromium, 15 to 50 wt.% nickel, and 0.6 to 4 wt.% silicon, based on the total weight of the alloy.

11. The method of claim 10 wherein the cold-working is performed by a method selected from the group consisting of shot-peening, pilgering, swagging, rolling, and grit blasting.

12. The method of claim 10 wherein the refined recrystallized micrograin structure is to a uniform minimum depth of at least about 40 microns.

13. The method of claim 12 wherein the refined recrystallized micrograin structure is to a uniform minimum depth of at least about 100 microns.

14. The method of claim 10, 12 or 13 wherein the oxidizing atmosphere is selected from the group consisting of steam and a mixture of steam and hydrogen.

15. The method of claim 14 wherein the cold-worked surface is heated, in the oxidizing atmosphere, to a temperature of about 420° C. to about 800° C. for about 200 to about 500 hours.

16. The method of claim 14 wherein the austenitic stainless steel comprises about: 17 to 40 wt.% chromium, 15 to 50 wt.% nickel, 0.06 to 0.6 wt.% carbon, up to about 2 wt.% manganese, about 1 to 2.5 wt.% silicon, up to about 2 wt.% niobium, up to about 2 wt.% molybdenum, up to about 3 wt.% tungsten, up to about 17 wt.% cobalt, and the balance being iron, based on the total weight of the alloy.

17. The method of claim 14 wherein the inner surface of the tube, before cold-working, is susbtantially that of the bulk composition and the surface roughness is less than about 300 r.m.s.

18. The method of claim 17 wherein the recrystallized micrograin structure is substantially free of microporosity.

* * * * *